US008969721B2

(12) United States Patent
Morin et al.

(10) Patent No.: US 8,969,721 B2
(45) Date of Patent: Mar. 3, 2015

(54) BOOM TIP COVER

(71) Applicant: Cantega Technologies Inc., Edmonton (CA)

(72) Inventors: Leo Morin, Edmonton (CA); Edmond LeRouzic, Edmonton (CA); Keith Yeats, Edmonton (CA)

(73) Assignee: Cantega Technologies Inc., Edmonton, Alberta (CA)

( * ) Notice: Subject to any disclaimer, the term of this patent is extended or adjusted under 35 U.S.C. 154(b) by 189 days.

(21) Appl. No.: 13/887,146

(22) Filed: May 3, 2013

(65) Prior Publication Data

US 2014/0326496 A1 Nov. 6, 2014

(51) Int. Cl.
*B66C 23/88* (2006.01)

(52) U.S. Cl.
CPC ..... *B66C 23/88* (2013.01)
USPC ..... 174/5 R; 174/138 F; 174/139

(58) Field of Classification Search
USPC ..... 174/5 R, 138 F, 139; 439/212, 517
See application file for complete search history.

(56) References Cited

U.S. PATENT DOCUMENTS

| | | | | |
|---|---|---|---|---|
| 4,845,307 | A * | 7/1989 | Cumming et al. | 174/5 R |
| 5,796,032 | A * | 8/1998 | Hadley | 174/5 R |
| 6,255,597 | B1 | 7/2001 | Bowling et al. | |
| 6,730,852 | B1 * | 5/2004 | Puigcerver et al. | 174/138 F |
| 6,878,883 | B1 | 4/2005 | Rauckman | |
| 2008/0123254 | A1 | 5/2008 | Niles | |
| 2008/0128163 | A1 | 6/2008 | Bradford et al. | |

FOREIGN PATENT DOCUMENTS

| | | |
|---|---|---|
| JP | 2001078322 | 3/2001 |
| WO | 2011094870 | 8/2011 |

OTHER PUBLICATIONS

"Greenjacket Summary Points", Salisbury by Honeywell, Jun. 2011, Bolingbrook, IL.
"2007 Outage Protection", Salisbury Lineman Safety Products, 2007, Skokie, IL.
"AltaLink Proactively Reduces Risk of Power Outages, Protects Wildlife . . . etc.", Salisbury by Honeywell, Nov. 2010, Bolingbrook, IL.
"Community Connections", Shell Scotford, Sep. 2009, Fort Saskatchewan, AB, Canada.

(Continued)

*Primary Examiner* — Dhirubhai R Patel
(74) *Attorney, Agent, or Firm* — Anthony R. Lambert

(57) ABSTRACT

A protector for a boom tip for use within an electrical power transmission system, the protector including: one or more walls having a boom tip enclosure side, an exterior side, and one or more terminal edges that define a boom tip entrance; and a guide shoulder contoured along the boom tip enclosure side to define an installation path for a part of the boom tip to contact and follow relative to the protector. A method of installing a protector on a boom tip for use within an electrical power transmission system, the method including: positioning the protector so that the boom tip is between one or more terminal edges of the protector, and a part of the boom tip is adjacent an initial portion of a guide shoulder contoured along a boom tip enclosure side of the protector; and advancing the protector into an installed position over the boom tip by allowing the part to follow an installation path defined by the guide shoulder.

21 Claims, 6 Drawing Sheets

(56) References Cited

OTHER PUBLICATIONS

"Greenjacket Energized Site Assessment", Salisbury by Honeywell, Aug. 2010, Bolingbrook, IL.
"Frequently Asked Questions", Salisbury by Honeywell, Sep. 2010, Bolingbrook, IL.
"Insulation Enhancement—Substation Asset Protection for Wildlife—BCIC-10D-18", Tyco Electronics [online], accessed May 20, 2008, http://energy.tycoelectronics.com.
"Salisbury Industrial Catalog", Salisbury by Honeywell, 2011, Bolingbrook, IL.
"Outage Protection", Salisbury by Honeywell, Bolingbrook, Il., accessed 2009.
"Greenjacket: You can prevent animal outages", Salisbury by Honeywell, 2011, Bolingbrook, IL.
"Greenjacket: Site Protection Plan", Salisbury by Honeywell, Jul. 2011, Bolingbrook, IL.
"The Case for Animal Coverup", Salisbury by Honeywell, Jul. 2010, Bolingbrook, IL.
"Salisbury Utility Products", Salisbury by Honeywell, 2012, Bolingbrook, IL.

* cited by examiner

BOOM TIP COVER

TECHNICAL FIELD

This document relates to apparatuses and methods for protecting boom tips for use within electrical power transmission systems.

BACKGROUND

Components such as conductors, equipment, or support structures of electrical transmission systems may present dangers of electrocution to workers operating within the system, either through direct contact with the system or indirect contact for example through the boom of a utility truck. There exist a variety of covers used to insulate components of electrical power systems from short circuits caused by contact. Existing covers have edges that can be spread apart to allow the cover to be placed over the component.

SUMMARY

A protector is disclosed for a boom tip for use within an electrical power transmission system, the protector comprising: one or more walls having a boom tip enclosure side, an exterior side, and one or more terminal edges that define a boom tip entrance; and a guide shoulder contoured along the boom tip enclosure side to define an installation path for a part of the boom tip to contact and follow relative to the protector.

A method is disclosed of installing a protector on a boom tip for use within an electrical power transmission system, the method comprising: positioning the protector so that the boom tip is between one or more terminal edges of the protector, and a part of the boom tip is adjacent an initial portion of a guide shoulder contoured along a boom tip enclosure side of the protector; and advancing the protector into an installed position over the boom tip by allowing the part to follow an installation path defined by the guide shoulder.

An apparatus is also disclosed comprising: a boom tip with a dielectric boom tip cover.

In various embodiments, there may be included any one or more of the following features: At least a portion of the installation path is directed away from the boom tip entrance. The guide shoulder has at least a first guide portion and a second guide portion, the first guide portion defining a first installation path axis, and the second guide portion defining a second installation path axis that is angled relative to the first installation path axis. At least a portion of the installation path is arcuate. The at least a portion of the installation path that is arcuate defines a pivot axis that passes through the protector. The guide shoulder originates from one of the one or more terminal edges. A second boom tip contact point on the boom tip enclosure side of the one or more walls is displaced from the installation path and oriented to face a first plane defined coplanar with a first boom tip contact point on the guide shoulder when the protector is in a partially installed position. The second boom tip contact point is on a second guide shoulder contoured along the boom tip enclosure side to define a second installation path for a second part of the boom tip to contact and follow relative to the protector. A third boom tip contact point and a fourth boom tip contact point, both on the boom tip enclosure side of the one or more walls, are oriented to face opposite respective faces of a second plane defined parallel to the installation path and perpendicular to the first plane when the protector is in a partially installed position. Both of the third boom tip contact point and the fourth boom tip contact point are each perpendicular to both of the first boom tip contact point and the second boom tip contact point. The third boom tip contact point is on a third guide shoulder contoured along the boom tip enclosure side to define a third installation path for a third part of the boom tip to contact and follow relative to the protector. The guide shoulder comprises two or more first guide shoulders angled relative to one another and contoured along the boom tip enclosure side to define the installation path for the part of the boom tip to contact and follow relative to the protector, and in which the first boom tip contact point is on a first of the two or more first guide shoulders and the fourth boom tip contact point is on a second of the two or more first guide shoulders. The guide shoulder comprises two or more first guide shoulders angled relative to one another and contoured along the boom tip enclosure side to define the installation path for the part of the boom tip to contact and follow relative to the protector. The guide shoulder is formed in a covered slot in the boom tip enclosure side. The one or more terminal edges include a pair of opposed flanges, and the pair of opposed flanges converge towards one another with increasing distance from an initial portion of the guide shoulder. The boom tip is located on a truck. The protector is constructed at least in part with dielectric material. At least a portion of the installation path is arcuate, and advancing further comprises rotating the protector into the installed position. Rotating further comprises wedging open a pair of opposed flanges, of the one or more terminal edges, that converge with increasing radial distance from a pivot axis defined by the protector, in which the flanges are shaped to snap around a backside of the boom tip when in the installed position. The part protrudes laterally relative to a plane defined by the installation path.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

Figure 1A:
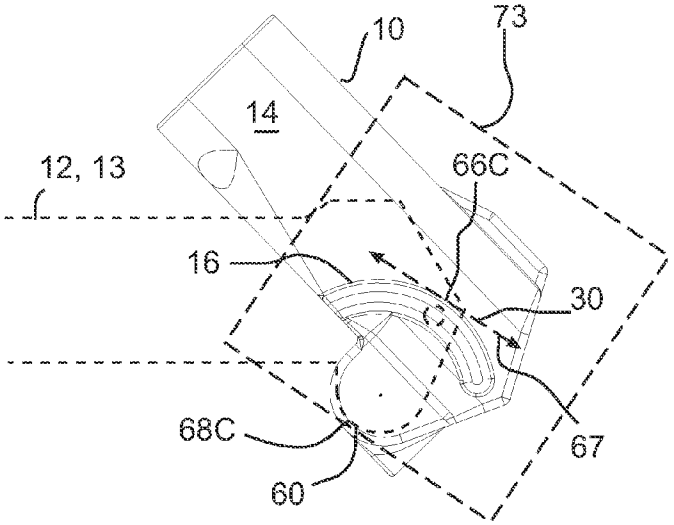
FIG. 1A is a side elevation view of the protector of FIG. 1 positioned in a partially installed position over the boom tip.
Figure 1B:
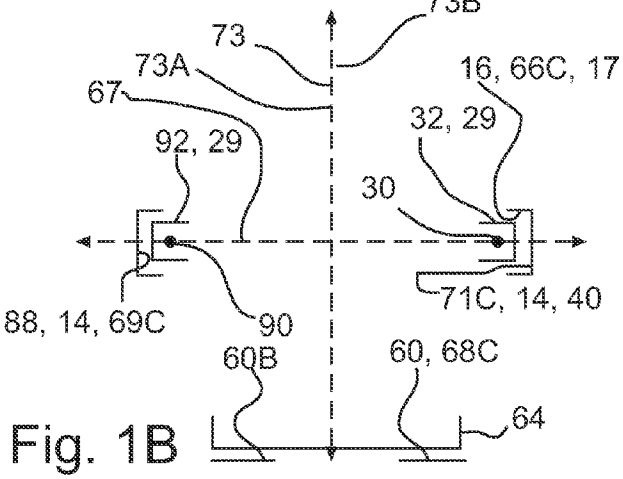
FIG. 1B is a front elevation section view of the guide shoulders of the protector of FIG. 1A in the partially installed position.
Figure 1:
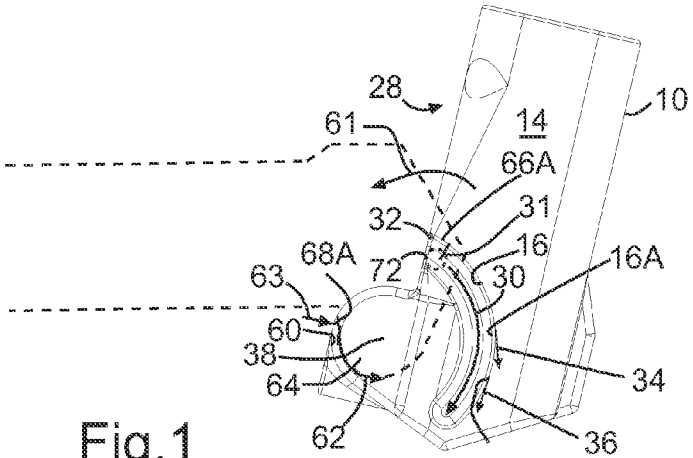
FIG. 1 is a side elevation view of a protector positioned in an initial installation position over a boom tip shown in dashed lines.
Figure 2:
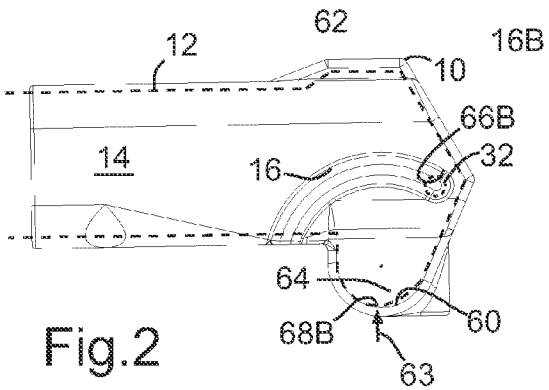
FIG. 2 is a side elevation view of the protector of FIG. 1 positioned in an installed position over the boom tip.
Figure 3B:
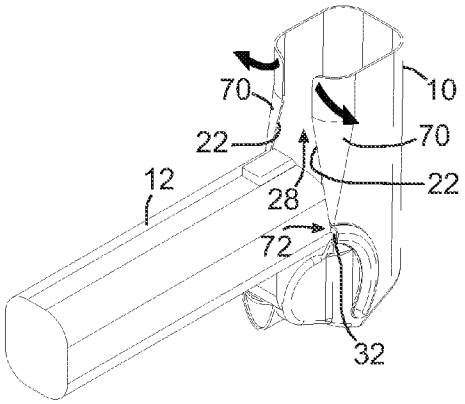
FIGS. 3A-D are perspective views illustrating a sequence of steps involved in installing the protector of FIG. 1 over the boom tip.
Figure 3D:
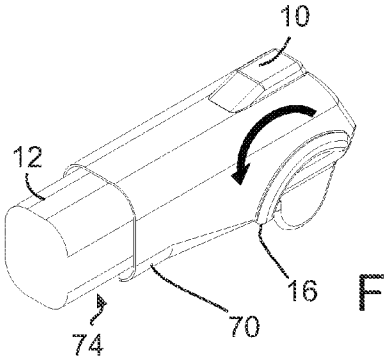
Figure 3A:
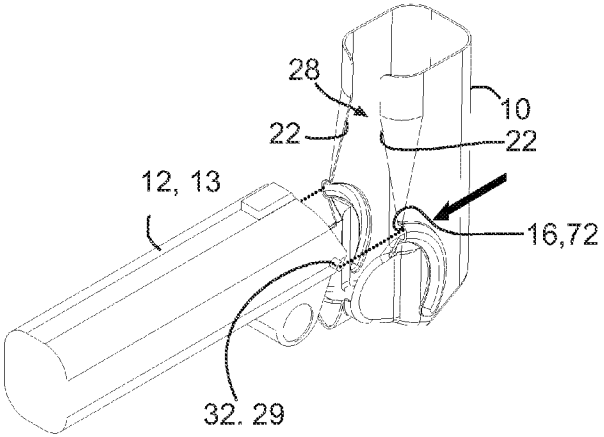
Figure 3C:
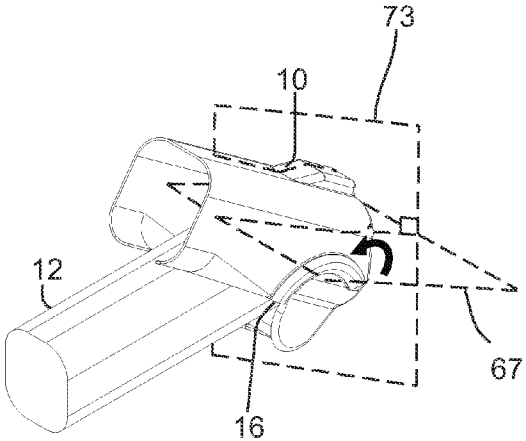
Figure 5:
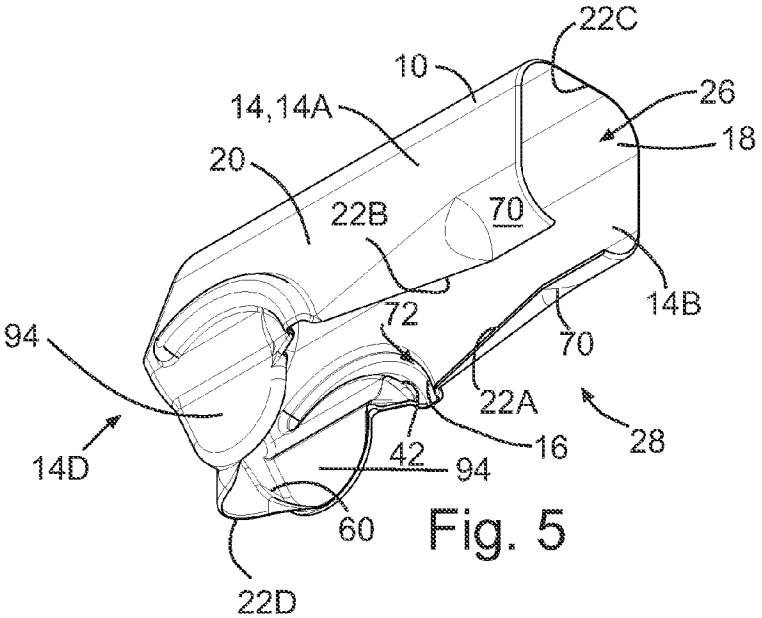
FIGS. 4-5 are bottom perspective views of the protector of FIG. 1.
Figure 4:
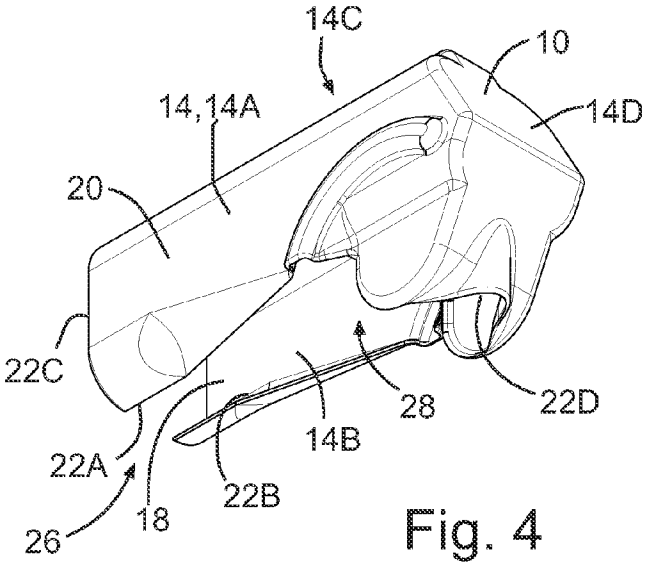
Figure 8B:
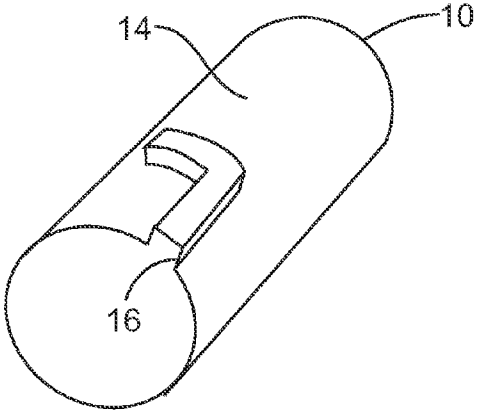
FIGS. 8A and 8B are side elevation and perspective views, respectively, of a protector for a pipe bus, with the pipe bus illustrated in FIG. 8A in dashed lines.
Figure 9B:
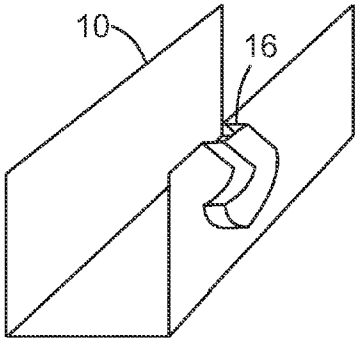
FIGS. 9A and 9B are side elevation and perspective views, respectively, of a protector for a sliding bus, with the sliding bus illustrated in FIG. 9A in dashed lines.

Referring to FIGS. 1-2, 3A-D, and 4-7, a protector 10 for a boom tip 12 for use within an electrical power transmission system is illustrated. The protector 10 has one or more walls 14 and one or more guide shoulders 16 (FIGS. 1-2 and 4-5). Wall 14 may form a cover for the boom tip 12 as shown. There may be more than one walls 14, for example side walls 14A and 14B, rear wall 14C, and top wall 14D in the example shown (FIGS. 4-7). Wall 14 may also have a suitable shape such as a cylinder (shown in FIG. 8B for example). Wall 14 has a boom tip enclosure side 18, an exterior side 20, and one or more terminal edges 22 that define a boom tip entrance 24 (FIGS. 4-5). Enclosure side 18 defines a boom tip enclosure 26, inside which the boom tip 12 is retained upon installation (FIG. 2). Edge 22 may include plural terminal edges 22, for example base edges 22A, 22B, front edge 22C, and rear edge 22D. Edge 22 defines a boom tip entrance 28 (FIGS. 3A, 4-5).

Guide shoulder 16 is contoured along the boom tip enclosure side 18 of walls 14 (FIGS. 4-5). Guide shoulder 16 defines an installation path 30 for a part 32, for example a protrusion extended perpendicular to guide shoulder 16 and installation path 30 as shown, of the boom tip 12 to contact and follow relative to the protector 10 (FIGS. 1 and 2). Thus, guide shoulder 16 may be oriented such that a line 31 normal to guide shoulder 16 is perpendicular to installation path 30 along each point of installation path 30 as shown. Thus, guide shoulder 16 allows boom tip 12 to advance along and into protector 10, while stopping boom tip 12 from moving laterally off installation path 30.

Figure 8A:
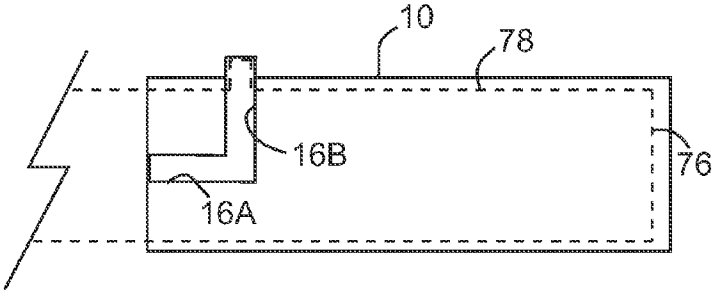
Figure 9A:
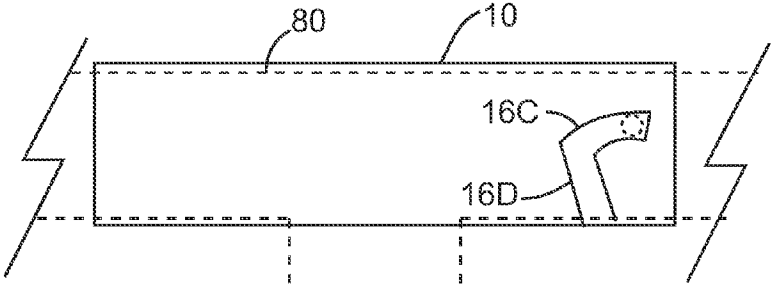

Guide shoulder 16 may have at least a first guide portion 16A and a second guide portion 16B (FIG. 1) that contact part 32 at different stages of an installation cycle. First guide portion 16A defines a first installation path axis 34, and the second guide portion 16B defines a second installation path axis 36 that is angled relative to the first installation path axis 34. Thus, protector 10 may install by one directional movement followed by another distinct directional movement. Axes 34 and 36 are tangent to portions 16A, and 16B, respectively as shown. An example of a protector 10 with only two portion guide portions 16A and 16B is shown in FIG. 8A. However, guide shoulder 16 may have more than two portions 16A and 16B, for example if at least a portion or the entirety of guide shoulder 16 is arcuate as shown (FIG. 1). When partially or fully arcuate, at least a portion of the installation path 30 may define a pivot axis 38. Pivot axis 38 may pass through the protector 10, for example perpendicular to installation path 30 as shown. In other cases pivot axis 38 may pass outside of protector 10. Using an arcuate guide shoulder 16 means that the protector 10 cannot merely slide in a single direction off boom tip 12 once installed. Although FIG. 1 illustrates a fully arcuate guide portion 16, FIG. 9A illustrates an example where guide shoulder 16 has an arcuate portion 16C and a linear portion 16D. The guide shoulder or guide shoulders 16 used in a protector 10 may be designed to impart rotational or translational installation movements over boom tip 12.

Figure 5A:
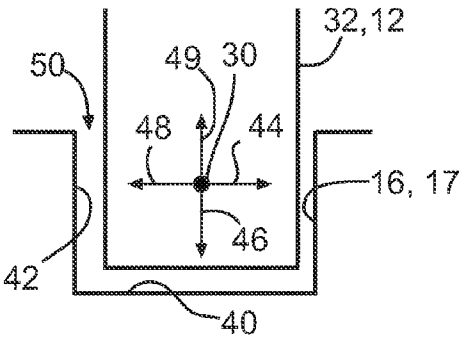
FIG. 5A is a view taken along the installation path at the entrance of the covered guide slot of FIG. 1.
Figure 6:
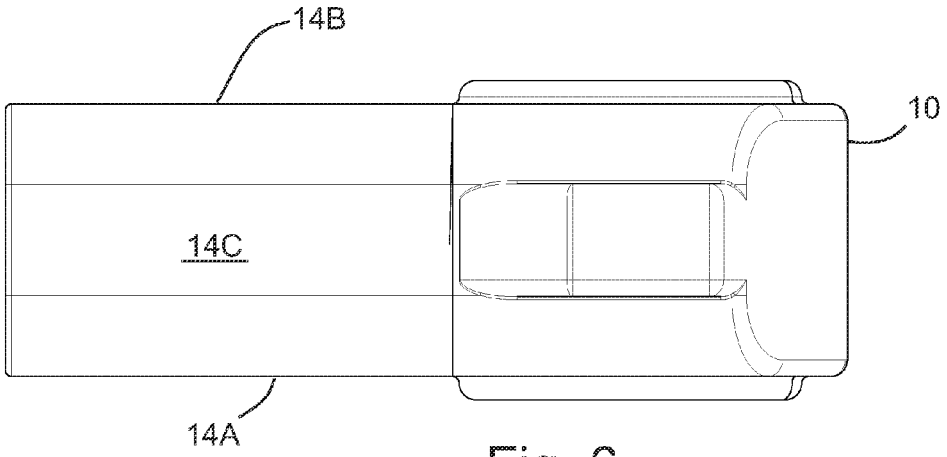
FIG. 6 is a top plan view of the protector of FIG. 1.
Figure 7:
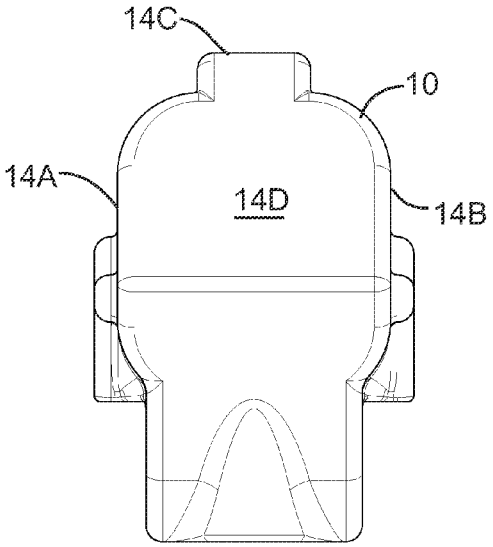
FIG. 7 is a rear end elevation view of the protector of FIG. 1.

Referring to FIGS. 1, 5, and 5A, guide shoulder 16 may include more than one guide shoulders, for example guide shoulders 16, 40 and 42, for cooperating to define installation path 30 of part 32. Guide shoulders 16, 40, 42 are angled relative to one another and cooperate to each align part 32 along installation path 30, for example by each stopping part 32 from movement along respective lateral directions 44, 46, and 48 (FIG. 5A). Like shoulder 16, shoulders 40 and 42 are thus normal to installation path 30 as shown. The guide slot 50 may be covered as shown. Other suitable shapes for slot 50 may be used. Shoulder 16 may be defined in a groove, flange or other suitable feature. Part 32 may protrude laterally relative to a plane defined by the installation path. The one or more guide shoulders 16 may be an infinite series of guide shoulders such as that defined by a cylinder in cross section.

Referring to FIGS. 1, 2, and 4, in addition to guide shoulder 16 a second guide shoulder, for example guide shoulder 60, may be contoured along the boom tip enclosure side 18. Guide shoulder 60 may define a second installation path 62 for a second part 64 of the boom tip 12 to contact and follow relative to the protector 10 (FIG. 1). Arrows 63 are used to indicate an initial portion of guide shoulder 60 (FIGS. 1 and 2). As with guide shoulder 16, guide shoulder 60 may be partially or fully arcuate as shown. During an installation cycle, shown for example in the sequence from FIG. 1 to FIG. 2, planes (not shown) defined coplanar with respective boom tip 12 contact points, for example points 66A and 68A (FIG. 1) or points 66B and 68B (FIG. 2), of the first guide shoulder 16 and the second guide shoulder 60 face each other. By facing one another in such a manner, shoulders 16 and 60 cooperate to retain boom tip 12 between shoulders 16 and 60 and prevent undesired rotation in the example shown. Also, shoulders 16 and 60 each restrict movement of respective parts 32 and 64, ensuring that boom tip 12 is guided properly into the installed position shown in FIG. 2. Guide surface 60 may track along a curved surface, such as provided by second part 64, on the boom tip 12, with the curved surface defining the pivot axis 38. The part 32 may extend in a direction parallel to pivot axis 38 so that boom tip 12.

Referring to FIGS. 1A, 1B, and 3C, some embodiments of protector 10 may be understood by considering how protector 10 functions in a partially installed position. In this example, a first boom tip contact point 66C and a second boom tip contact point 68C are illustrated, with point 68C being on the boom tip enclosure side 18 of the one or more walls 14 (FIG. 1A). Second boom tip contact point 68C is illustrated as being displaced from the installation path 30 of guide shoulder 16, and oriented to face a first plane 67 defined coplanar with first boom tip contact point 66C (FIGS. 1A, 1B, and 3C). For ease of illustration, installation path 30 and first plane 67 denote the same dashed line in FIG. 1A, although for installation path 30 this line is understood to denote a line, while for first plane 67 the line is intended to denote a plan perpendicular with the page. Second boom tip contact point 68C may be on the second guide shoulder 60 as shown.

Third and fourth boom tip contact points 69C and 71C, respectively, may also be defined on the boom tip enclosure side 18 of the one or more walls 14 (FIG. 1B). Third and fourth boom tip contact points 69C and 71C are oriented to face opposite respective faces 73A, 73B of a second plane 73 defined parallel to the installation path 30 and perpendicular to the first plane 67. In some cases such as the one illustrated both of the third boom tip contact point 69C and the fourth boom tip contact point 71C are each perpendicular to both of the first boom tip contact point 66C and the second boom tip contact point 68C. The third boom tip contact point 69C may be on a third guide shoulder 88 contoured along the boom tip enclosure side 18 to define a third installation path 90 for a third part 92 (FIG. 3A) of the boom tip 12 to contact and follow relative to the protector 10 (FIG. 1B). As shown, the first boom tip contact point 66C is on a first of the two or more first guide shoulders 16, for example guide shoulder 17, and the fourth boom tip contact point 71C is on a second of the two or more first guide shoulders 16, for example guide shoulder 40. A fourth guide shoulder 60B may be provided similar to guide shoulder 60. These combinations guide shoulders restrain the boom tip 12 from movement in certain undesired directions during installation, and thus improve installation. Once the protector 10 is located in the initial position (FIG. 1), a push from almost any suitable point on the protector 10 will allow the protector to close as shown due to the guiding action of the guide shoulders.

Referring to FIG. 1, at least a portion of the installation path 30 may be directed away from the boom tip entrance 28. In some cases the guide shoulder 16 originates from one of the one or more terminal edges 22. As the boom tip 12 enters entrance 28, boom tip 12 tracks into the boom tip enclosure via guide shoulder 16 present on the boom tip enclosure side of walls 14. Entrance 28 may face into the direction of rotation 61 of protector 10 relative to the boom tip 12.

Figure 10:
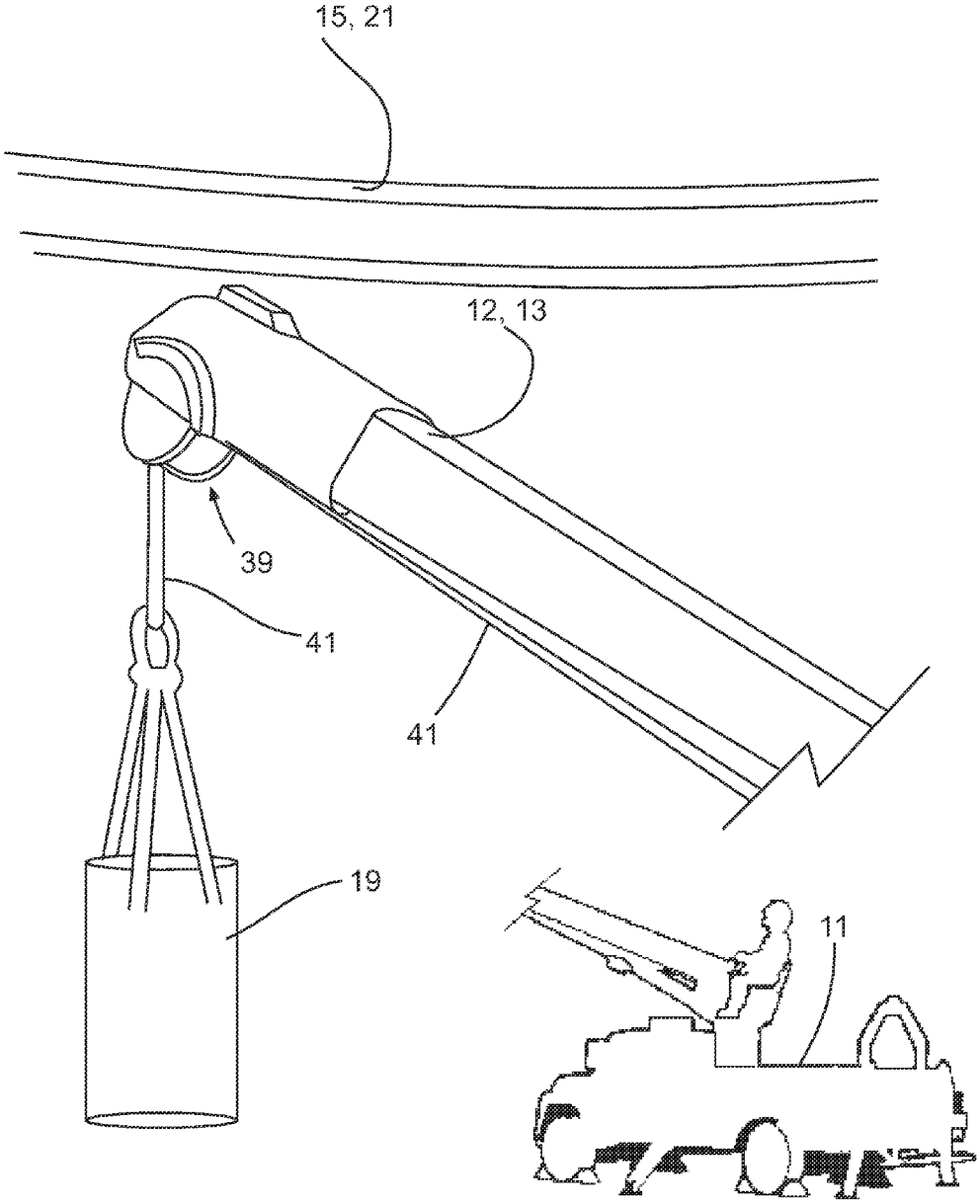
FIG. 10 is a perspective view of a protected boom tip, from a derrick digger truck, being positioned in an electrical power transmission system.

Referring to FIG. 10, the boom tip 12 may be for use within transmission system 15. For example boom tip 13 may be located on a truck 11 such as a derrick digger truck as shown. Thus, the protector 10 may be shaped as a boom tip cover as shown. A boom tip 13 may be used to carry various payloads 19 within the vicinity of an electrical power transmission system 15, in this case overhead power lines 21. Parts 32 and 92 may be the ends of a cable axle 29 of boom tip 13 (FIGS. 1B and 3A). Protector 10 may have an underside cable passage or opening 39 for a boom cable 41. In other cases, protector 10 may be designed to fit components 12 that form part of electrical power transmission systems. For example, referring to FIG. 8A, protector 10 is shaped to cover the end 76 of a pipe bus 78. Referring to FIG. 9A, protector 10 is shaped to cover a sliding bus 80. Other shapes and applications may be used.

Referring to FIGS. 1, 2, and 3A-D, an exemplary method of installing a protector 10 on a boom tip 12 for use within an electrical power transmission system is illustrated. In a first stage, the protector 10 is positioned so that the boom tip 12 is between one or more terminal edges 22, and a part 32 of the boom tip 12 is adjacent an initial portion 72 of guide shoulder 16 (FIGS. 1 and 3A-B). In a second stage the protector 10 is advanced into an installed position (FIG. 3D) over the boom tip 12 by allowing the part 32 to follow an installation path 30 (FIG. 1) defined by the guide shoulder 16 (FIGS. 2, 3C-D). Boom tip entrance 28 may also point downwards when installed as shown.

Referring to FIGS. 3B, 3D, and 5, the one or more terminal edges 22 may include a pair of opposed flanges 70. The pair of opposed flanges 70 may converge towards one another with increasing distance from an initial portion 72 of the guide shoulder 16 (FIGS. 3B and 5). Flanges 70 may converge with increasing radial distance from pivot axis 38 if guide shoulder 16 is designed to rotate relative to the boom tip 12 on advancement. Such convergence helps the flanges 70 be progressively wedged outwards during installation instead of improperly bending inward into boom tip enclosure 26. As the boom tip 12 enters the boom tip entrance 28 during install, the flanges 70 are wedged open (FIG. 3B). However, once the boom tip 12 is in the installed position, the flanges 70 may close, for example by snapping, around a backside 74 of the boom tip 12 (FIG. 3D). Lips or flanges 70 may restrict removal of protector 10.

The protector 10 may be made at least in part with dielectric material. The dielectric material may comprise a single part material or multiple part material mixed before application, and may be formulated from a combination of liquid and semi-solid or solid boom tips. Electrical transmission system may refer to any apparatus intended to transmit power. It will be understood that the teachings equally apply and may be adapted to any commercially used voltage range or any suitable transmission system. Adhesive, for example pre-applied on the protector 10, may be used to affix the protector 10 to the boom tip 12.

Non conductive protectors 10 are advantageous because they allow users 54 to encroach on the safe limits of approach. For example, with a protector 10 in place a user 54 is allowed to make accidental brush contact with the protector 10 while the system is energized.

Photogrammetry may be used to determine the shape of the boom tip 12, and determine the location of suitable parts 32 for corresponding guide shoulders 16, and determining other relevant characteristics of protector 10 such as the pivot axis or inner contour of boom tip enclosure side 18.

Guide shoulder 16 may have more than one arcuate portions with varying radii of curvature. Protector 10 may be designed to use combinations of translational and rotational installation movements. Guide shoulders 16 may allow ninety degrees or less of rotation. Edges 22 may be secured together after installation, for example using fasteners, for further example through cooperating flanges. Shoulder 16 may be defined by an uncovered slot, for example a slot with shoulders 42 and 16 but lacking shoulder 40 (FIG. 5A). The guide shoulder or shoulders may span more than one wall 14. Opposed pads 94 may grip the boom tip 12 and may assist in defining a hinge point at pivot axis 38 to close the protector 10 over boom tip 12 (FIG. 3). Each installation path, such as paths 30, 62, and 90 may be a range of paths defined by the relevant volume of the respective part 32, 64, and 92 that is guided by the local or nearest respective guide shoulder. More than 4 guide shoulders may be present. Each guide shoulder may be a covered slot. Boom tip contact points are points on the protector 10 where the installation cycle position has the parts located nearest to or in contact with the respective contact point. Contact is not required in use other than to restrain the protector 10 to ensure proper installation. Protectors 10 may be designed with ample clearance between boom tip 12 and protector 10 walls 14, even between guide shoulder and respective boom tip part, in order to reduce jamming during installation. Each guide shoulder may satisfy the first, second, third, and fourth boom tip contact criteria at two, more than two, a majority, or all partially installed positions. Directional words such as up or down are understood to be relative phrases and are not intended to be limited to being defined relative to the surface of the earth.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A protector for a boom tip for use within an electrical power transmission system, the protector comprising:

one or more walls having a boom tip enclosure side, an exterior side, and one or more terminal edges that define a boom tip entrance; and a first guide shoulder contoured along an inside of the boom tip enclosure side to define an installation path for a part of the boom tip to contact and follow the first guide shoulder relative to the protector.

2. The protector of claim 1 in which at least a portion of the installation path is directed away from the boom tip entrance.

3. The protector of claim 1 in which the first guide shoulder has at least a first guide portion and a second guide portion, the first guide portion defining a first installation path axis, and the second guide portion defining a second installation path axis that is angled relative to the first installation path axis.

4. The protector of claim 3 in which at least a portion of the installation path is arcuate.

5. The protector of claim 4 in which the at least a portion of the installation path defines a pivot axis that passes through the protector.

6. The protector of claim 1 in which the first guide shoulder originates from one of the one or more terminal edges.

7. The protector of claim 1 in which a second boom tip contact point on the boom tip enclosure side of the one or more walls is displaced from the installation path and oriented to face a first plane defined coplanar with a first boom tip contact point on the first guide shoulder when the protector is in a partially installed position.

8. The protector of claim 7 in which the second boom tip contact point is on a second guide shoulder contoured along the boom tip enclosure side to define a second installation path for a second part of the boom tip to contact and follow the second guide shoulder relative to the protector.

9. The protector of claim 8 in which a third boom tip contact point and a fourth boom tip contact point, both on the boom tip enclosure side of the one or more walls, are oriented to face opposite respective faces of a second plane defined parallel to the installation path and perpendicular to the first plane when the protector is in a partially installed position.

10. The protector of claim 9 in which both of the third boom tip contact point and the fourth boom tip contact point are each perpendicular to both of the first boom tip contact point and the second boom tip contact point.

11. The protector of claim 9 in which the third boom tip contact point is on a third guide shoulder contoured along the boom tip enclosure side to define a third installation path for a third part of the boom tip to contact and follow the third guide shoulder relative to the protector.

12. The protector of claim 11 in which the first guide shoulder comprises two or more first guide shoulders angled relative to one another and contoured along the boom tip enclosure side to define the installation path for the part of the boom tip to contact and follow the first guide shoulder relative to the protector, and in which the first boom tip contact point is on a first of the two or more first guide shoulders and the fourth boom tip contact point is on a second of the two or more first guide shoulders.

13. The protector of claim 12 in which the first guide shoulder is formed in a covered slot in the boom tip enclosure side.

14. The protector of claim 1 in which the first guide shoulder comprises two or more first guide shoulders angled relative to one another and contoured along the boom tip enclosure side to define the installation path for the part of the boom tip to contact and follow the first guide shoulder relative to the protector.

15. The protector of claim 1 in which the one or more terminal edges include a pair of opposed flanges, and the pair of opposed flanges converge towards one another with increasing distance from an initial portion of the first guide shoulder.

16. The protector of claim 1 in which the boom tip is located on a truck.

17. The protector of claim 1 constructed at least in part with dielectric material.

18. A method of installing a protector on a boom tip for use within an electrical power transmission system, the method comprising:

positioning the protector so that the boom tip is between one or more terminal edges of the protector, and a part of the boom tip is adjacent an initial portion of a first guide shoulder contoured along an inside of a boom tip enclosure side of the protector, the protector having an exterior side; and advancing the protector into an installed position over the boom tip by allowing the part to follow an installation path defined by the first guide shoulder.

19. The method of claim 18 in which at least a portion of the installation path is arcuate, and advancing further comprises rotating the protector into the installed position.

20. The method of claim 19 in which rotating further comprises wedging open a pair of opposed flanges, of the one or more terminal edges, that converge with increasing radial distance from a pivot axis defined by the protector, in which the flanges are shaped to snap around a backside of the boom tip when in the installed position.

21. The method of claim 18 in which the part protrudes laterally relative to a plane defined by the installation path.

* * * * *